US010811818B2

(12) United States Patent
Komori et al.

(10) Patent No.: US 10,811,818 B2
(45) Date of Patent: Oct. 20, 2020

(54) WIRE HOLDING STRUCTURE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hirokazu Komori, Mie (JP); Tomohiko Kobayashi, Mie (JP); Naomichi Kawashima, Mie (JP); Takahiro Murata, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/281,149

(22) Filed: Feb. 21, 2019

(65) Prior Publication Data

US 2019/0288445 A1 Sep. 19, 2019

(30) Foreign Application Priority Data

Mar. 15, 2018 (JP) ..... 2018-047784

(51) Int. Cl.
*H01R 13/58* (2006.01)
*H01R 13/506* (2006.01)
*H01R 13/52* (2006.01)

(52) U.S. Cl.
CPC ..... *H01R 13/5825* (2013.01); *H01R 13/506* (2013.01); *H01R 13/5205* (2013.01); *H01R 13/5837* (2013.01)

(58) Field of Classification Search
CPC combination set(s) only.
See application file for complete search history.

(56) References Cited

U.S. PATENT DOCUMENTS 5,329,806 A * 7/1994 McClanahan ..... G01N 27/4062 436/137
5,365,779 A * 11/1994 Vander Velde ..... G01N 1/2226 73/86
5,482,076 A * 1/1996 Taylor ..... F16L 55/134 137/318
6,066,801 A * 5/2000 Kodaira ..... H04N 7/104 174/41
6,261,108 B1 * 7/2001 Kanagawa ..... H01R 13/6592 439/98
6,419,521 B2 * 7/2002 Kanagawa ..... H01R 13/6592 439/582

(Continued)

FOREIGN PATENT DOCUMENTS

JP 2017-118624 6/2017

*Primary Examiner* — Binh B Tran
*Assistant Examiner* — Krystal Robinson
(74) *Attorney, Agent, or Firm* — Gerald E. Hespos; Michael J. Porco; Matthew T. Hespos

(57) ABSTRACT

A wire holding structure (11) for wires (10) includes wires (10), a rubber plug (34) having wire through holes (35) having the wires (10) passed therethrough, a housing (22) externally fit to the rubber plug (34) and a wire cover (15) configured to cover the housing (22). The wire cover (15) includes an opening (24), and the housing (22) includes a lid (33) shaped to correspond to the opening (24) and configured to close the opening (24).

9 Claims, 6 Drawing Sheets

(56) References Cited

U.S. PATENT DOCUMENTS

| | | | | |
|---|---|---|---|---|
| 6,793,532 | B2 * | 9/2004 | Saito | H01R 9/032 174/360 |
| 6,814,617 | B2 * | 11/2004 | Oota | H01R 13/5205 174/365 |
| 8,118,613 | B2 * | 2/2012 | Rapp | H01R 9/0518 439/585 |
| 8,410,360 | B2 * | 4/2013 | Nishimura | H02G 3/22 174/50.5 |
| 8,808,012 | B2 * | 8/2014 | Omae | H01R 4/646 439/98 |
| 9,793,692 | B1 * | 10/2017 | Pogash | H01B 7/0216 |
| 10,153,070 | B2 * | 12/2018 | Makino | B29C 45/14549 |
| 2001/0045425 | A1 * | 11/2001 | Pauli | A01K 63/065 219/544 |
| 2002/0052141 | A1 * | 5/2002 | Hattori | H01R 13/5205 439/587 |
| 2002/0101041 | A1 * | 8/2002 | Kameyama | H01R 13/521 277/628 |
| 2002/0168896 | A1 * | 11/2002 | Suzuki | H01R 13/4365 439/595 |
| 2003/0085070 | A1 * | 5/2003 | Wickstrom | H04R 1/44 181/135 |
| 2005/0056791 | A1 * | 3/2005 | Donaghue | G01T 1/244 250/394 |
| 2006/0032653 | A1 * | 2/2006 | Minoshima | H01R 13/5216 174/564 |
| 2006/0276080 | A1 * | 12/2006 | Kameyama | H01R 13/5205 439/587 |
| 2013/0059469 | A1 * | 3/2013 | Kawakita | H02G 15/013 439/589 |
| 2018/0109097 | A1 * | 4/2018 | Komori | H02G 15/013 |

* cited by examiner

WIRE HOLDING STRUCTURE

BACKGROUND

Field of the Invention

This specification relates to a wire holding structure.

Related Art

Japanese Unexamined Patent Publication No. 2017-118624 relates to a waterproofed wire holding structure that includes a rubber plug externally fit around a wire and a cap externally fit to this rubber plug. In this way, a clearance between the wire and the cap is sealed in a liquid-tight manner. A holder is fit externally to the cap to hold relative positions of the wire, the rubber plug and the cap. According to this configuration, a wall of the cap and a wall of the holder overlap in a thickness direction of the wall of the cap. This has led to a problem of enlarging the wire holding structure.

This specification was completed on the basis of the above situation and aims to provide a miniaturized wire holding structure.

SUMMARY

This specification is directed to a wire holding structure with a wire and a rubber plug including a wire through hole having the wire passed therethrough. A housing is fit externally to the rubber plug, and a wire cover is configured to cover the wire by being mounted on the housing. The wire cover includes an opening, and the housing includes a lid shaped to correspond to the opening and configured to close the opening. According to the above configuration, the housing and the wire cover do not overlap in a region where the lid of the housing closes the opening of the wire cover. Thus, the wire holding structure for the wire can be miniaturized as a whole.

In one embodiment, a thickness T1 of the lid, a thickness T2 of a wall of the housing and a thickness T3 of a wall of the wire cover satisfy the following Equation (1):

$$T2 \leq T1 < T2 + T3 \quad (1).$$

According to the above configuration, the thickness T1 of the lid is smaller than the sum of the thickness T2 of the wall of the housing and the thickness T3 of the wall of the wire cover. Thus, the wire holding structure for the wire reliably can be miniaturized.

A flange may project out on an opening edge part of the opening of the wire cover. Additionally, a contact rib may be provided on the lid of the housing. The contact rib may project toward the flange and may be configured to come into contact with the flange.

The contact rib of the lid contacts the flange to prevent intrusion of external matter into the wire cover through the opening of the wire cover.

A fitting to be fit into a space formed between an outer surface of the housing and the contact rib may be provided in a region inward of the flange on the opening edge of the opening of the wire cover. According to this configuration, a labyrinth structure is formed by a clearance between the contact rib and the fitting and a clearance between the fitting and the outer surface of the housing. In this way, external matter cannot intrude into the wire cover.

The fitting may have a conforming surface in conformity with the shape of the outer surface of the housing in a region facing the outer surface of the housing. This configuration makes a clearance between the outer surface of the housing and the conforming surface of the fitting smaller and further prevents intrusion of an external matter through the clearance between the housing and the fitting portion.

The structure disclosed herein permits miniaturization a wire holding structure.

DETAILED DESCRIPTION

A wire holding structure 11 for wires 10 disclosed in this specification is applied to a connector 12 is described with reference to FIGS. 1 to 8. The connector 12 according to this embodiment is used in such an environment that many external matters are present such as the inside of a tire house of a vehicle. In the following description, a Z direction is referred to as an upward direction, a Y direction is referred to as a forward direction and an X direction is referred to as a leftward direction. Note that, for identical members, only some members may be denoted by a reference sign.

Connector 12

Figure 1:
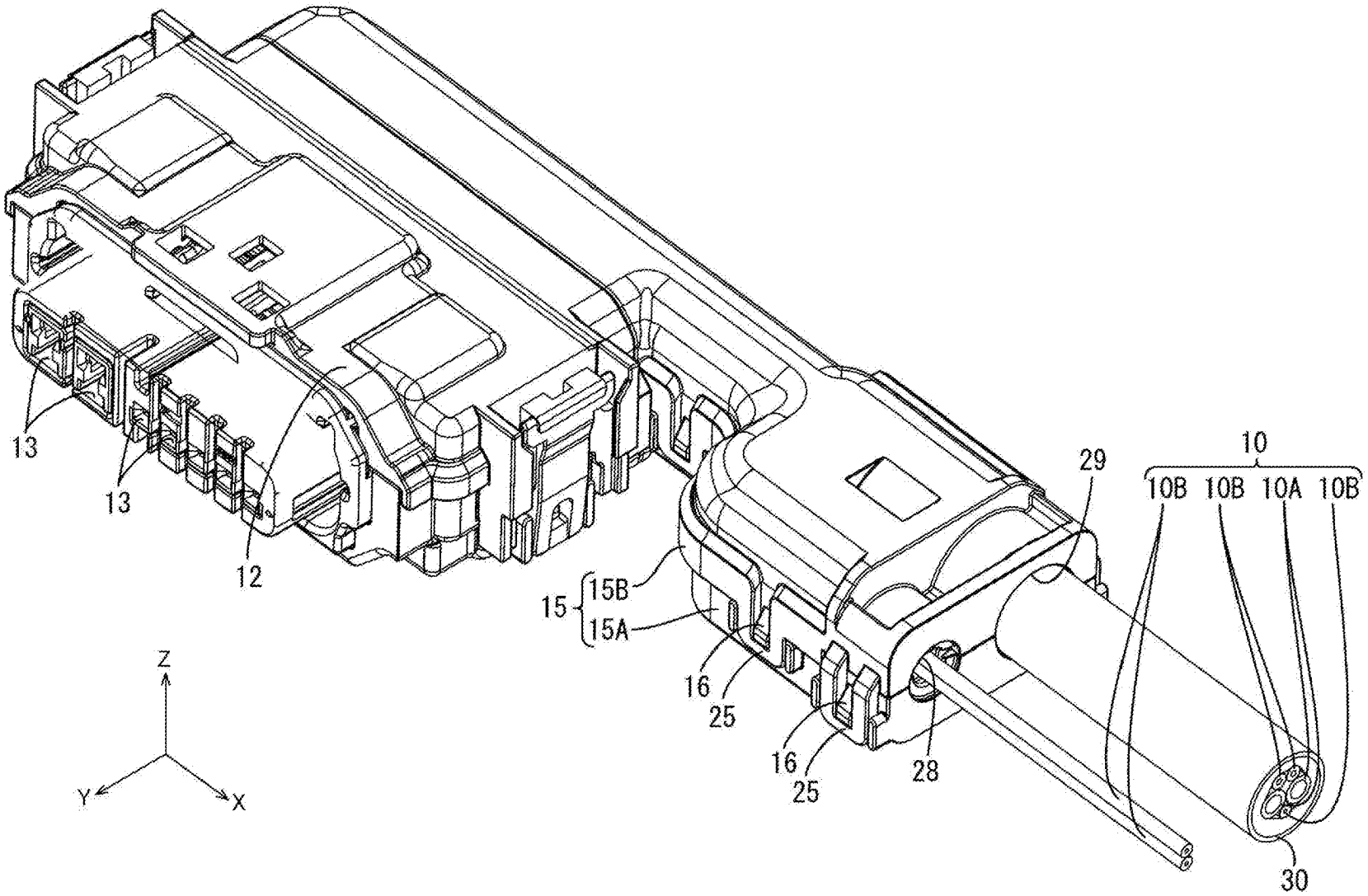
FIG. 1 is a perspective view showing a connector according to one embodiment.

As shown in FIG. 1, the connector 12 is in the form of a block and is formed by injection molding insulating synthetic resin. The connector 12 includes cavities 13 for respectively accommodating terminals (not shown). The cavities 13 are open forwardly of the connector 12.

Wires 10 are drawn out from a rear end part of the connector 12. The connector 12 and the wires 10 are sealed in a liquid-tight manner by a known method, such as an unillustrated rubber plug. The terminal is connected to an end part of each wire 10. The terminal is retained and accommodated in the cavity 13. The wires 10 include two large-diameter wires 10A having a relatively large diameter and five small-diameter wires 10B having a smaller diameter than the large-diameter wires 10A.

Wire Cover 15

Figure 2:
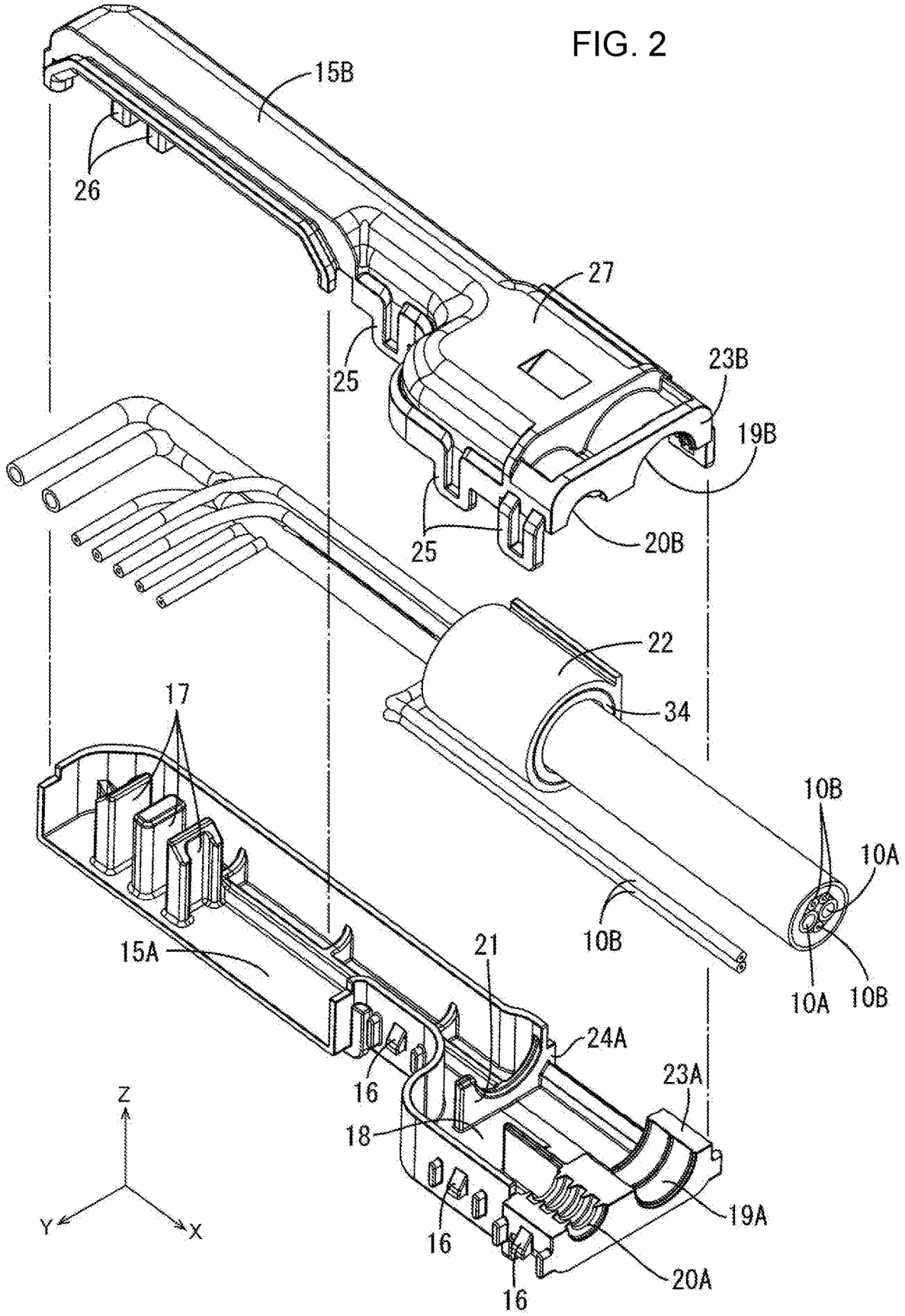
FIG. 2 is an exploded perspective view showing a first wire cover, a second wire cover, a housing, a rubber plug and wires.
Figure 3:
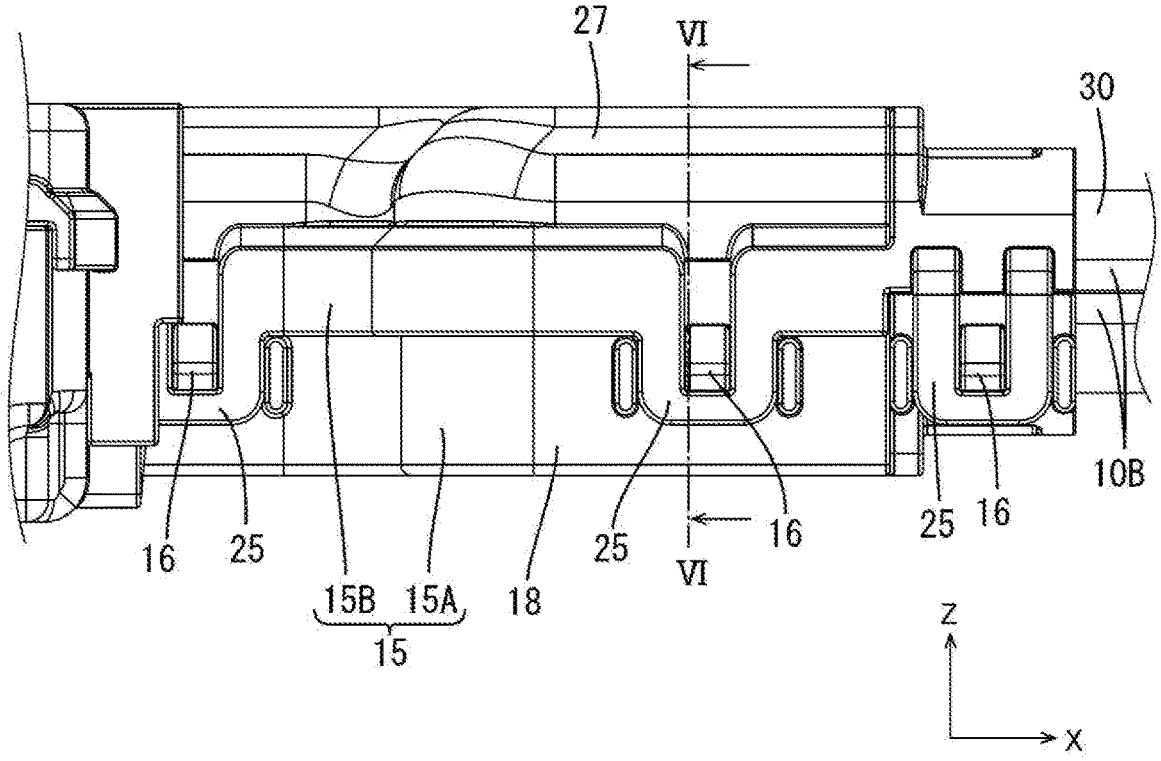
FIG. 3 is a partial enlarged front view showing a locking structure of the first and second wire covers.

A wire cover 15 for covering the wires 10 drawn out rearward of the connector 12 is mounted on the rear part of the connector 12. As shown in FIG. 2, the wire cover 15 is long and narrow in a lateral direction. The wire cover 15 is formed by injection molding insulating synthetic resin and includes a first wire cover 15A open upward and a second wire cover 15B to be assembled with the first wire cover 15A from above.

First Wire Cover 15A

The first wire cover 15A includes a bottom wall and a side wall rising up from a side of the bottom wall. Lock protrusions 16 project out on the outer surface of the side wall.

Holding ribs 17 rise up from the bottom wall and extend in a front-rear direction at positions near a right end part of the bottom wall. The two large-diameter wires 10A are held in clearances formed between adjacent ones of the holding ribs 17.

A right half of a front wall on a front side of the first wire cover 15A is open to mount the connector 12.

A part of the first wire cover 15A near a left end serves as a first branching portion 18 widened in the front-rear direction. The two large-diameter wires 10A, three small-diameter wires 10B and two small-diameter wires 10B are disposed in the first branching portion 18 in a branched manner. The two large-diameter wires 10A and the three small-diameter wires 10B are disposed in a rear part of the first branching portion 18 and the two small-diameter wires 10B are disposed in a front part of the first branching portion 18.

A left side wall 23A of the first wire cover 15A located on the left end part is thick in a lateral direction. A main line draw-out recess 19A through which the two large-diameter wires 10A and the three small-diameter wires 10B are drawn out is formed by recessing a rear side of the upper surface of the left side wall 23A downward. A branch line draw-out recess 20A through which the two small-diameter wires 10B are drawn out is formed by recessing the front side of the upper surface of the left side wall 23A downward.

A sandwiching rib 21 projects up at a position near the right end part on the bottom wall of the first branching portion 18 and extends in the front-rear direction. A housing 22 to be described later is sandwiched between the sandwiching rib 21 and the left side wall 23A of the first branching portion 18.

A first opening 24A is formed in the rear wall of the first branching portion 18 and opens rearward.

Second Wire Cover 15B

The second wire cover 15B includes an upper wall and a side wall extending down from a side edge of the upper wall. Lock receiving portions 25 are formed on the outer surface of the side wall at positions corresponding to the lock protrusions 16 of the first wire cover 15A. The lock receiving portions 25 are substantially U-shaped. The lock protrusions 16 and the lock receiving portions 25 are engaged so that the first and second wire covers 15A, 15B are assembled (see FIG. 3).

As shown in FIG. 2, ribs 26 extend down from the upper wall and extend in the front-rear direction at positions near a right end part of the upper wall of the second wire cover 15B. These ribs 26 are inserted between adjacent holding ribs 17 formed in the first wire cover 15A. The two large-diameter wires 10A held between the holding ribs 17 also are held from above by the ribs 26.

A right half of a front wall of the side wall of the second wire cover 15B is open to mount the connector 12.

A part of the second wire cover 15B near a left end is a second branching portion 27 widened in the front-rear direction. The two large-diameter wires 10A, three small-diameter wires 10B and two small-diameter wires 10B are disposed in the second branching portion 27 in a branched manner. The two large-diameter wires 10A and the three small-diameter wires 10B are disposed in a rear part of the second branching portion 27 and the two small-diameter wires 10B are disposed in a front part of the second branching portion 27.

A left side wall 23B of the second wire cover 15B is thick in the lateral direction. A main line draw-out recess 19B through which the two large-diameter wires 10A and the three small-diameter wires 10B are drawn out is formed by recessing a rear side of the lower surface of the left side wall 23B upward. A branch line draw-out recess 20B through which the two small-diameter wires 10B are drawn out is formed by recessing the front side of the lower surface of the left side wall 23B upwardly.

Figure 4:
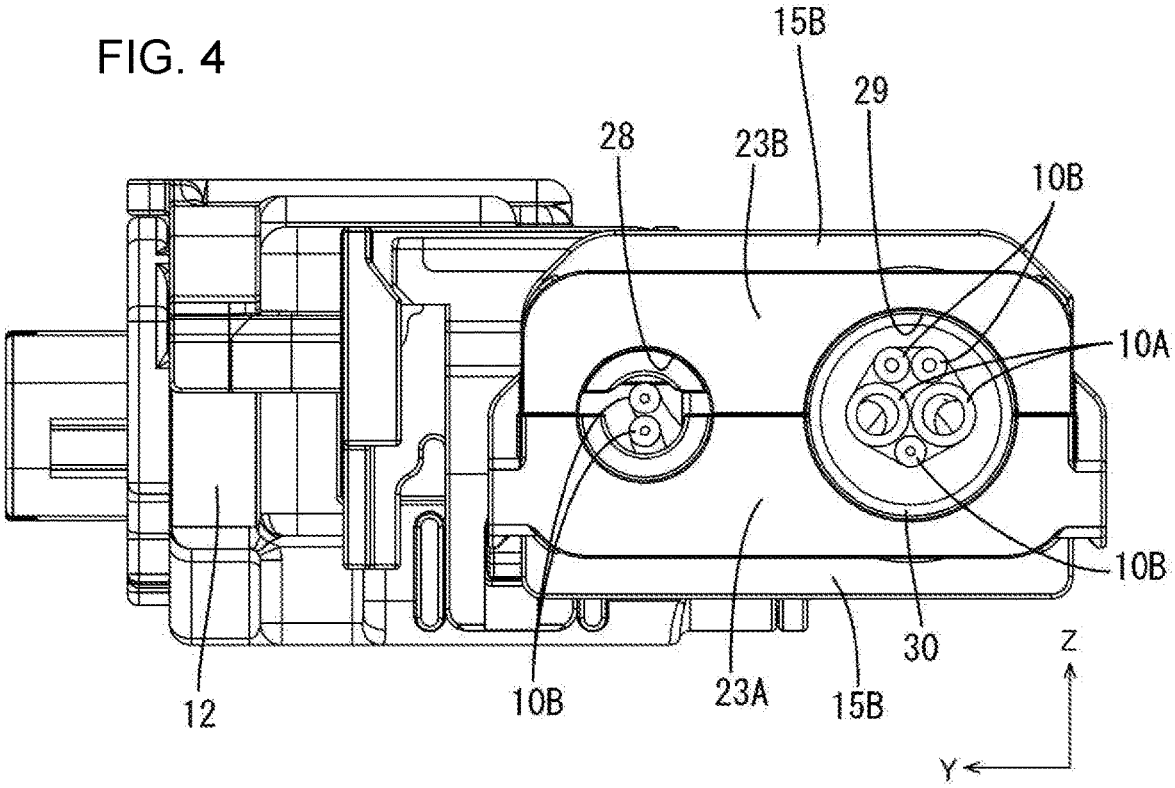
FIG. 4 is a left side view showing the wires drawn out from a wire cover.

As shown in FIG. 4, with the first and second wire covers 15A, 15B integrally assembled, a branch line draw-out opening 28 is formed by the branch line draw-out recess 20A of the first wire cover 15A and the branch line draw-out recess 20B of the second wire cover 15B, and the two small-diameter wires 10B are drawn out leftward from this branch line draw-out opening 28.

Further, with the first and second wire covers 15A, 15B assembled, a main line draw-out opening 29 is formed by the main line draw-out recess 19A of the first wire cover 15A and the main line draw-out recess 19B of the second wire cover 15B, and the two large-diameter wires 10A and three small-diameter wires 10B are drawn out in a state covered by a sheath 30 made of synthetic resin from this main line draw-out opening 29.

A second opening 24B is formed in the rear wall of the second branching portion 27 and opens rearward.

Housing 22

Figure 5:
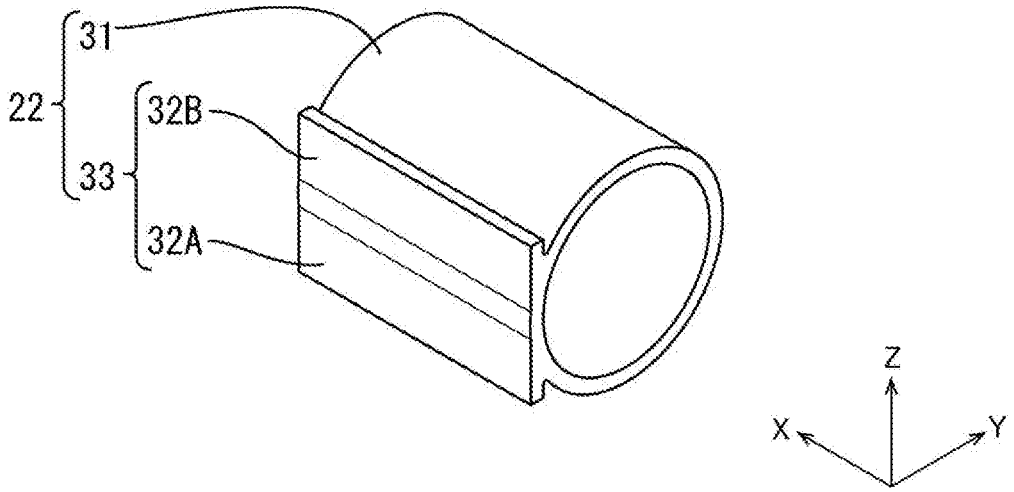
FIG. 5 is a perspective view showing the housing.

The housing 22 is formed by injection molding synthetic resin. As shown in FIG. 5, the housing 22 includes a laterally extending cylindrical portion 31. A downward extending first contact rib 32A and an upward extending second contact rib 32B are provided on a rear part of the cylindrical portion 31. The rear surface of the first contact rib 32A, that of the second contact rib 32B and that of the cylindrical portion 31 are flush with each other and form a lid 33. The lid 33 has a rectangular shape when viewed laterally.

Rubber Plug 34

Figure 7:
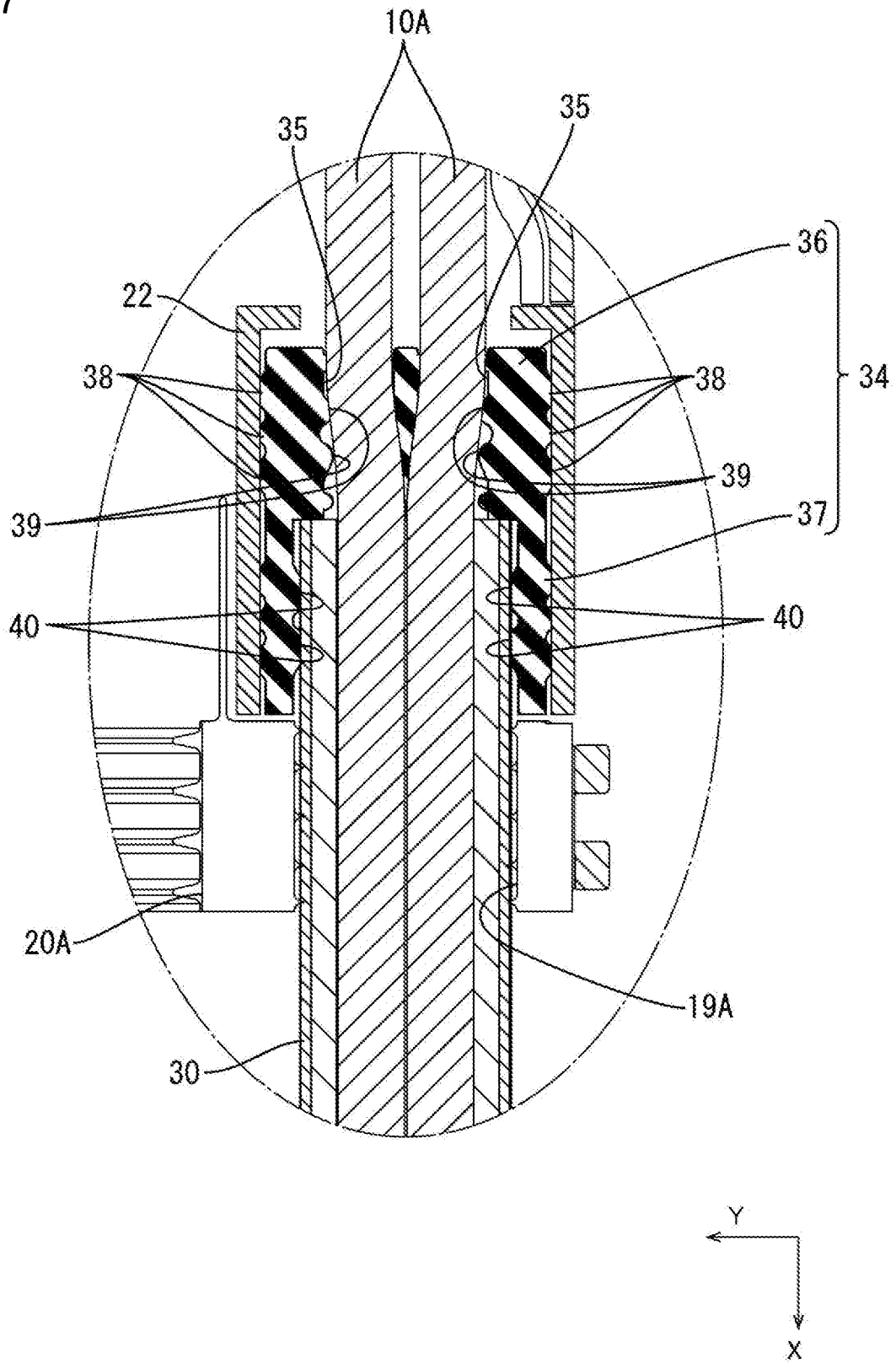
FIG. 7 is a partial enlarged section showing the wire holding structure.

As shown in FIG. 7, the rubber plug 34 is fit inside the cylindrical portion 31. The rubber plug 34 includes a wire passage portion 36 having wire through holes 35 through which the large-diameter wires 10A and the small-diameter wires 10B are passed, and a sheath fitting portion 37 extending leftward of the wire passage portion 36 and to be fit externally to the sheath 30.

Outer peripheral lips 38 are formed on the outer peripheral surface of the rubber plug 34 to project radially of the rubber plug 34 and extend in a circumferential direction of the rubber plug 34 to have an annular shape. These outer peripheral lips 38 are held in close contact with the inner wall of the cylindrical portion 31 of the housing 22, thereby sealing between the rubber plug 34 and the housing 22 in a liquid-tight manner.

Wire lips 39 are formed in each of the wire through holes 35 to project radially inward of the wire through hole 35 and extend in a circumferential direction of the wire through hole 35 to have an annular shape. These wire lips 39 are held in close contact with the outer surfaces of the large-diameter wires 10A and the outer surfaces of the small-diameter wires 10B, thereby sealing between the rubber plug 34 and the large-diameter wires 10A and small-diameter wires 10B in a liquid-tight manner.

Sheath lips 40 are formed in the sheath fitting portion 37 to project radially inwardly of the sheath fitting portion 37 and extend in a circumferential direction of the sheath fitting portion 37 to have an annular shape. These sheath lips 40 are held in close contact with the outer surface of the sheath 30, thereby sealing between the rubber plug 34 and the sheath 30 in a liquid-tight manner.

Figure 6:
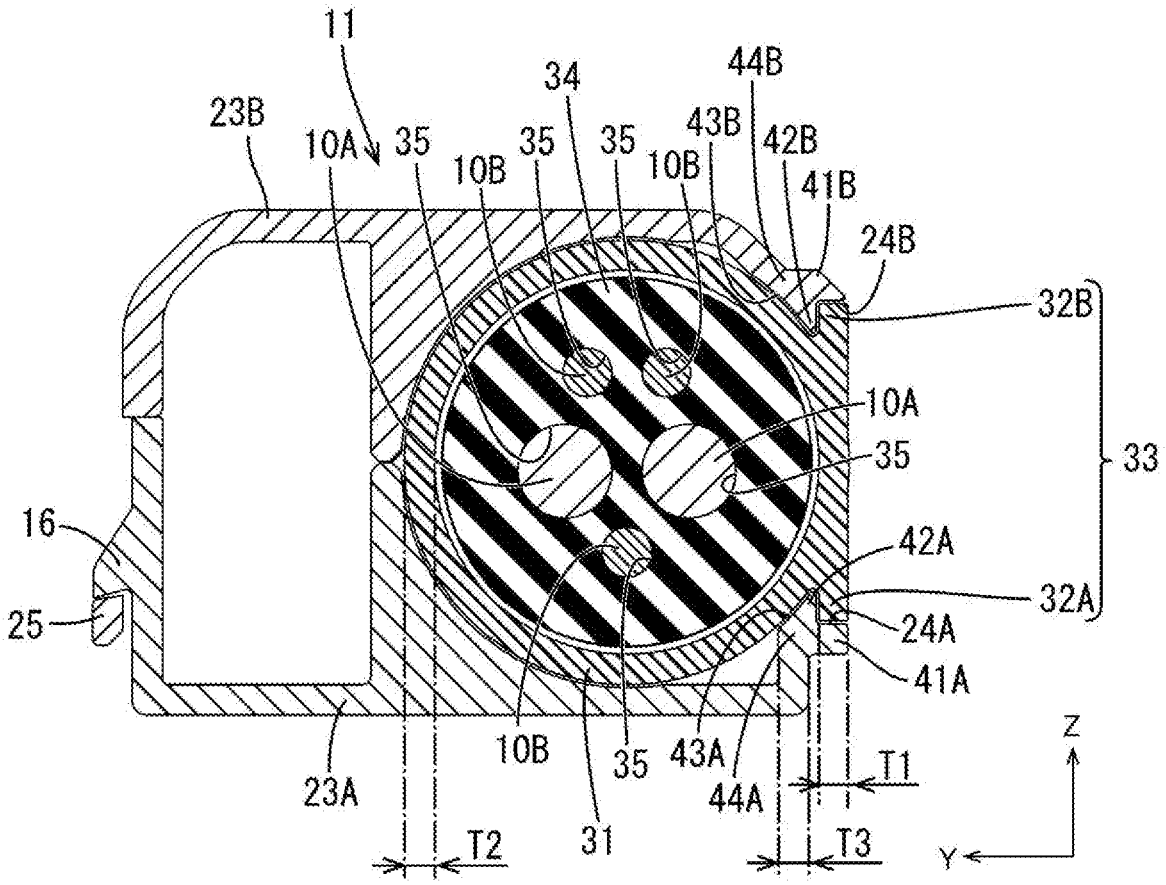
FIG. 6 is a section along VI-VI in FIG. 3 showing a wire holding structure.
Figure 8:
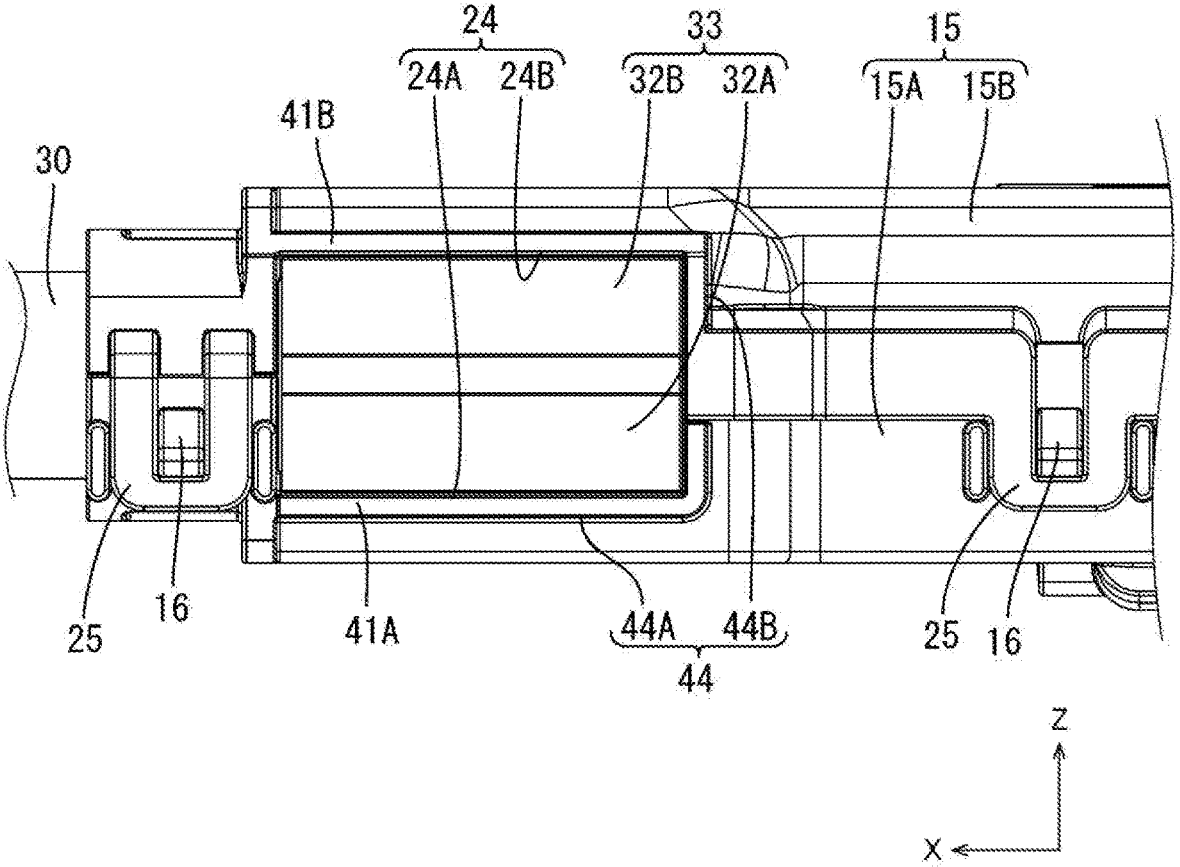
FIG. 8 is a partial back view showing a state where an opening is closed by a lid.

As shown in FIG. 6, with the first and second wire covers 15A, 15B assembled, the wire cover 15 is formed with an opening 24 open rearward by the first and second openings 24A, 24B. As shown in FIG. 8, the opening 24 has a rectangular shape when viewed from behind. The shape of the lid 33 corresponds to that of the opening 24. In this way, the lid 33 of the housing 22 closes the opening 24 of the wire cover 15 with the housing 22 disposed in the wire cover 15.

As shown in FIG. 6, first and second flanges 41A and 41B are formed on the outer surface of an opening edge 44 of the opening 24 of the wire cover 15. The first flange 41A projects rearward from a position below the opening 24 and the second flange 41B projects rearward from a position above the opening 24. The first contact rib 32A of the lid 33 contacts the first flange 41A from above, and the second contact rib 32B of the lid 33 comes into contact with the second flange 41B from below.

The opening edge 44 of the first opening 24A of the first wire cover 15A includes a first fitting 42A shaped to correspond to a clearance formed between the cylindrical portion 31 and the first contact rib 32A of the housing 22 and to be fit into this clearance. A first conforming surface 43A shaped in conformity with the outer surface of the cylindrical portion 31 is formed in a region of the first fitting 42A facing the cylindrical portion 31. The first conforming surface 43A constitutes a part of an arcuate surface.

The opening edge 44 of the second opening 24B of the second wire cover 15B includes a second fitting 42B shaped to correspond to a clearance formed between the cylindrical portion 31 and the second contact rib 32B of the housing 22 and to be fit into this clearance. A second conforming surface 43B shaped in conformity with the outer surface of the cylindrical portion 31 is formed in a region of the second fitting 42B facing the cylindrical portion 31. The second conforming surface 43B is part of an arcuate surface.

As shown in FIG. 6, if T1 denotes a thickness of the lid 33, T2 denotes a thickness of the cylindrical portion 31 of the housing 22 and T3 denotes a thickness of the rear wall of the wire cover 15, T1, T2 and T3 satisfy the following Equation (1).

$$T2 \leq T1 < T2 + T3 \quad (1)$$

Assembling Method of Embodiment

Next, an assembling method of this embodiment is described. The assembling method of this embodiment is not limited to the one described below.

The two large-diameter wires 10A and the three small-diameter wires 10B are drawn out from an end of the sheath 30. The large-diameter wires 10A and the small-diameter wires 10B are passed through the wire through holes 35 formed in the wire passage 36 of the rubber plug 34. In this way, sealing is provided between the large-diameter wires 10A and small-diameter wires 10B and the rubber plug 34 in a liquid-tight manner.

The sheath fitting 37 of the rubber plug 34 is fit externally to the end part of the sheath 30. In this way, sealing is provided between the sheath 30 and the rubber plug 34. The housing 22 is fit externally fit to the rubber plug 34. In this way, sealing is provided between the rubber plug 34 and the housing 22.

The ends of the large-diameter wires 10A and the small-diameter wires 10B are connected to the terminals and the terminals are accommodated into the cavities 13 from behind. The first wire cover 15A is mounted on the rear end of the connector 12 from below. The two large-diameter wires 10A are disposed respectively between adjacent ones of the three holding ribs 17. The housing 22 is disposed between the sandwiching rib 21 and the left side wall 23A. The two large-diameter wires 10A are disposed in the first branching portion 18. The second wire cover 15B is assembled from above the first wire cover 15A. The lock receiving portions 25 are engaged resiliently with the lock protrusions 16. At this time, the two ribs 26 are inserted respectively between adjacent ones of the three holding ribs 17. In this way, the two large-diameter wires 10A are held reliably.

With the first and second wire covers 15A, 15B assembled, the opening 24 is closed by the lid 33. In this way, the connector 12 according to this embodiment is completed.

Functions and Effects of Embodiment

Next, functions and effects of this embodiment are described. The wire holding structure 11 for the wires 10 according to this embodiment includes the wires 10, the rubber plug 34 having the wire through holes 35 with the wires 10 passed therethrough, the housing 22 externally fit to the rubber plug 34 and the wire cover 15 configured to cover the housing 22. The wire cover 15 includes the opening 24, and the housing 22 includes the lid 33 shaped to correspond to the opening 24 and configured to cover the opening 24. According to this configuration, since the housing 22 and the wire cover 15 do not overlap in a region where the lid 33 of the housing 22 closes the opening 24 of the wire cover 15. Thus, the wire holding structure 11 for the wires 10 can be miniaturized as a whole.

Further, the thickness T1 of the lid 33 satisfies the following Equation (1) with respect to the thickness T2 of the cylindrical portion 33 constituting the housing 22 and the thickness T3 of the rear wall constituting the wire cover 15.

$$T2 \leq T1 < T2 + T3 \quad (1)$$

According to the above configuration, the thickness T1 of the lid 33 is smaller than the sum of the thickness T2 of the cylindrical portion 33 of the housing 22 and the thickness T3 of the rear wall of the wire cover 15. Thus, the wire holding structure 11 for the wires 10 can be miniaturized.

Further, the first and second outwardly projecting flanges 41A, 41B are provided on the outer surface of the opening edge 44 of the opening 24 of the wire cover 15. Additionally, the first and second contact ribs 32A and 32B are provided on the lid 33 of the housing 22. The first contact rib 32A projects toward the first flange 41A and is configured to contact the first flange 41A. The second contact rib 32B projects toward the second flange 41B and is configured to contact the second flange 41B.

The first contact rib 32A of the lid 33 contacts the first flange 41A of the first wire cover 15A, and the second contact rib 32B of the lid 33 contacts the second flange 41B of the second wire cover 15B. Thus, external matter cannot intrude into the wire cover 15 through the opening 24 of the wire cover 15.

Further, according to this embodiment, the first and second fittings 42A, 42B to be fit into the spaces formed between the outer surface of the housing 22 and the first and second contact ribs 32A, 32B are provided in regions inward of the first and second flanges 41A, 41B on the opening edge part 44 of the opening 24 of the wire cover 15. According to this configuration, a labyrinth structure is formed by a clearance between the first contact rib 32A and the first fitting 42A and a clearance between the first fitting 42A and the outer surface of the housing 22. Similarly, a labyrinth structure also is formed by a clearance between the second contact rib 32B and the second fitting 42B, and a clearance between the second fitting 42B and the outer surface of the housing 22. In this way, the intrusion of external matter into the wire cover 15 can be further suppressed.

The first fitting portion 41A has the first conforming surface 43A in conformity with the shape of the outer surface of the housing 22 in a region facing the outer surface of the housing 22, and the second fitting 41B has the second conforming surface 43B in conformity with the shape of the outer surface of the housing 22 in a region facing the outer surface of the housing 22. According to this configuration, a clearance between the outer surface of the housing 22 and the first conforming surface 43A of the first fitting 42A can be made smaller and a clearance between the outer surface of the housing 22 and the second conforming surface 43B of the second fitting 42B can be made smaller. Thus, external matter cannot intrude through the clearances between the housing 22 and the first and second fittings 42A and 42B.

The invention is not limited to the above described and illustrated embodiment. For example, the following embodiments also are included in the scope of the technology disclosed in this specification.

Although seven wires 10 are drawn out from the connector 12 in this embodiment, one to six or more than seven wires may be drawn out.

Although the lid 33 includes the first and second contact ribs 32A, 32B in this embodiment, there is no limitation to this and one or both of the first and second contact ribs 32A, 32B may be omitted.

Although the first wire cover 15A includes the first fitting 42A and the second wire cover 15B includes the second fitting 42B in this embodiment, there is no limitation to this and either one or both of the first and second fitting portions 42A, 42B may be omitted.

Although the first fitting 42A is formed with the first conforming surface 43A and the second fitting 42B is formed with the second conforming surface 43B in this embodiment, there is no limitation to this and either one or both of the first and second conforming surface 43A, 43B may be omitted.

Although this embodiment relates to the wire holding structure 11 for the wires 10 drawn out from the connector 12, there is no limitation to this and a wire holding structure may be for wires drawn out from an arbitrary electrical device.

Although the sheath 30 is externally fit to the two large-diameter wires 10A and the three small-diameter wires 10B in this embodiment, the sheath 30 may be omitted.

Although the wires 10 include the two types of wires 10, i.e. the large-diameter wires 10A and the small-diameter wires 10B in this embodiment, there is no limitation to this and wires may include only wires having the same diameter or wires having three or more types of diameters.

LIST OF REFERENCE SIGNS

10: wire
10A: large-diameter wire
10B: small-diameter wire
11: wire holding structure
15: wire cover
15A: first wire cover
15B: second wire cover
22: housing
24: opening
24A: first opening
24B: second opening
32A: first contact rib
32B: second contact rib
33: lid
34: rubber plug
35: wire through hole
41A: first flange
41B: second flange
42A: first fitting
42B: second fitting
43A: first conforming surface
43B: second conforming surface
44: opening edge
44A: first opening edge part
44B: second opening edge

What is claimed is:

1. A wire holding structure, comprising:

a wire extending in a longitudinal direction;

a rubber plug including a wire through hole having the wire passed therethrough;

a housing having a tubular wall fit externally on the rubber plug;

a wire cover having an interior configured to cover the wire by being mounted on the housing, the wire cover including an opening open through the wire cover in a radial direction transverse to the longitudinal direction of the wire; and a lid integral with the housing, the lid being shaped to correspond to the opening in the wire cover and configured to close the opening.

2. The wire holding structure of claim 1, wherein a thickness T1 of the lid measured in a direction parallel to a radius of the wire passing centrally through the opening, a radial thickness T2 of the tubular wall the housing and a thickness T3 of a wall of the wire cover at a position adjacent the opening satisfy the following Equation (1):

$$T2 \leq T1 < T2 + T3 \quad (1).$$

3. The wire holding structure of claim 2, wherein:

an outward projecting flange is provided on an opening edge of the opening of the wire cover; and the lid of the housing includes a contact rib projecting toward the flange and configured to contact the flange.

4. The wire holding structure of claim 1, wherein the wire cover includes first and second fitting surfaces facing outward on the wire cover at positions adjacent the opening, first and second fitting flanges projecting out on the wire cover so that the first and second fitting surfaces are between the opening and the respective first and second fitting flanges, the lid of the housing includes first and second contact ribs, inwardly facing surfaces of the first and second contact ribs being engaged respectively against the first and second fitting surfaces of the wire cover, the first and second contact ribs having surfaces facing away from one another and engaged respectively against inwardly facing surfaces of the first and second fitting flanges.

5. The wire holding structure of claim 1, wherein the lid of the housing includes first and second contact ribs projecting away from one another and engaged respectively against first and second fitting surfaces facing out on the wire cover.

6. The wire holding structure of claim 5 wherein the wire cover includes opposed first and second opening edge parts adjacent the opening in the wire cover, the first and second opening edge parts of the wire cover being engaged between an outer surface area of the tubular wall of the housing and surfaces of the respective first and second contact ribs of the lid of the housing.

7. The wire holding structure of claim 1 wherein the wire cover includes first and second fitting flanges projecting out at positions substantially adjacent the opening in the wire cover, the lid of the housing having an outer surface substantially aligned with projecting ends of the first and second fitting flanges.

8. A wire holding structure, comprising:

a wire;

a rubber plug including a wire through hole having the wire passed therethrough;

a housing externally fit to the rubber plug; and a wire cover configured to cover the wire by being mounted on the housing;

the wire cover including an opening, the housing including a lid shaped to correspond to the opening and configured to close the opening, wherein:

an outward projecting flange is provided on an opening edge of the opening of the wire cover;

a contact rib projecting toward the flange and configured to contact the flange is provided on the lid of the housing a fitting to be fit into a space formed between an outer surface of the housing and the contact rib is provided in a region inward of the flange on the opening edge part of the opening of the wire cover; and a thickness T1 of the lid, a thickness T2 of a wall the housing and a thickness T3 of a wall of the wire cover satisfy the following Equation (1):

$$T2 \leq T1 < T2 + T3 \quad (1).$$

9. The wire holding structure of claim 8, wherein the fitting has a conforming surface in conformity with the shape of the outer surface of the housing in a region facing the outer surface of the housing.

* * * * *